US005573396A

United States Patent [19]

Swanson

[11] Patent Number: 5,573,396

[45] Date of Patent: Nov. 12, 1996

[54] LOW EMISSIONS BURNER

[75] Inventor: Malcolm L. Swanson, Chickamauga, Ga.

[73] Assignee: Astec Industries, Inc., Chattanooga, Tenn.

[21] Appl. No.: 333,970

[22] Filed: Nov. 3, 1994

[51] Int. Cl.[6] ..... F27B 7/02

[52] U.S. Cl. ..... 432/106; 432/103; 432/164; 432/186; 432/189; 431/12; 431/159; 431/181; 431/187; 431/254; 431/284

[58] Field of Search ..... 432/103, 105, 432/106, 118, 163, 164, 186, 189; 431/12, 159, 181, 187, 254, 284

[56] References Cited

U.S. PATENT DOCUMENTS

| | | | |
|---|---|---|---|
| 4,214,866 | 7/1980 | Thekdi et al. | 432/189 |
| 4,279,592 | 7/1981 | Grant | 432/105 |
| 4,428,309 | 1/1984 | Chang | 431/284 |
| 4,688,496 | 8/1987 | Schreter | 431/284 |
| 4,867,572 | 9/1989 | Brock et al. . | |
| 5,062,792 | 11/1991 | Maghon | 431/284 |
| 5,088,916 | 2/1992 | Furuhashi et al. | 431/12 |
| 5,211,331 | 5/1993 | Seel | 431/12 |
| 5,334,012 | 8/1994 | Brock et al. . | |
| 5,388,985 | 2/1995 | Musil et al. | 431/12 |
| 5,407,345 | 4/1995 | Robertson et al. | 431/115 |

*Primary Examiner*—Henry A. Bennett
*Assistant Examiner*—Siddharth Ohri
*Attorney, Agent, or Firm*—Nilles & Nilles, S.C.

[57] ABSTRACT

A premix burner assembly for heating the combustion chamber of a dryer for an HMA plant, soil remediation plant, or the like is designed to meet the very low emission limitations that are imposed in certain areas such as the southern portion of California. The burner assembly includes a burner, a primary nozzle, an air source connected to the burner, a fuel source, and a fuel injection system connected to the fuel source and to the burner. Premixing is achieved through the supply of a gaseous fuel from the fuel injection system into the burner upstream of the primary nozzle so as to lead to nearly complete premixing of the air and fuel prior to discharge into the combustion chamber, thereby permitting combustion of the fuel with only very small amounts of excess air. Burner efficiency is increased and emissions are further reduced by employing air distribution and control devices upstream of the fuel injection system and by carefully controlling the supply of both air and fuel to the burner. Preferably, burner firing is controlled by three separate controllers including a master firing rate controller, a gas supply controller, and an air supply controller which communicate with one another in different manners depending on whether or not the firing rate is increasing at a particular time.

25 Claims, 7 Drawing Sheets

LOW EMISSIONS BURNER

BACKGROUND OF THE INVENTION

1. Field of the Invention

The invention relates to burners and, more particularly, relates to gas fired burners usable to heat and dry materials in rotary drums commonly used in the production of hot mix asphalt (HMA) or in soil remediation.

2. Background of the Invention

Gas fired burners are nearly universally used to supply heat to rotary dryers of the type commonly used for the production of HMA or for soil remediation. Burners employed in such plants, commonly known as nozzle mix burners, typically supply air and a gaseous fuel to the combustion chamber of the dryer via separate inlets essentially resulting in simultaneous mixing and combustion. Combustion air for such burners is supplied directly by a primary blower and indirectly by a secondary blower or by convection. This technique leads to inefficient mixing and thus incomplete combustion of the fuel, resulting in the emission of increased levels of hydrocarbons and other volatile organic compounds (VOCs). VOC emissions from such burners will soon render their use unacceptable in many areas such as in the southern portion of California where ever stricter emission standards are being imposed.

VOC emissions from conventional nozzle mix burners can be reduced by supplying high amounts of excess air to the combustion chamber of the dryer (with excess air being defined as the amount in excess of that required for stoichiometric combustion), thereby promoting combustion of a higher percentage of fuel. Standard nozzle mix burners currently employed in most HMA plants require from 50% to 200% excess air.

The use of large amounts of excess air to reduce VOC emissions exhibits at least two drawbacks each of which could independently render standard nozzle mix burners commercially unacceptable in the near future. First, using large amounts of excess air significantly increases capital expenditure and production costs because larger and higher powered blowers are required to force the excess air through the system and because this excess air must be heated to maintain acceptable operating temperatures in the dryer, thereby requiring the consumption of more fuel. Second, combustion in the presence of excess air leads to increased NOx emissions levels because there is more free oxygen available to combine with nitrogen. Because NOx emissions are also heavily regulated, a plant which uses excess air in its burner to reduce VOC emissions may still fail to meet environmental regulations because of unacceptably high NOx emissions.

It is known in other industries to use premix burners to reduce VOC and NOx emissions by premixing the fuel and air prior to combustion, thereby reducing VOC emissions without requiring high amounts of excess air and thereby reducing NOx emissions. Such premix burners have, however, never gained acceptance in HMA or soil remediation plants, possibly because they employ a separate mixing device located upstream of the burner which substantially increases the cost and size of the burner assembly.

OBJECTS AND SUMMARY OF THE INVENTION

It is therefore an object of the invention to provide a premix burner assembly which is relatively simple in construction and operation and which is thus suitable for use in HMA plants, soil remediation plants, and the like but which still exhibits relatively low emission levels.

In accordance with a first aspect of the invention, this object is achieved by providing a burner assembly including a premix burner, an air source which supplies combustion air to the premix burner, and a fuel source which supplies gaseous fuel to the premix burner. The premix burner includes a primary nozzle having an inlet and having an outlet for discharging an air/fuel mixture into the dryer drum, a burner duct having an inlet connected to the air source and an outlet connected to the inlet of the primary nozzle, and a fuel injection system including a plurality of nozzles spaced around the duct between the inlet and the outlet, extending into the duct, and terminating in injection orifices opening into the duct.

The fuel source will typically comprise a manifold. In order to maximize fuel distribution and to promote premixing, the nozzles are preferably mounted on the manifold and extend radially into the duct in at least first, second, and third concentric rings with the orifices of each ring extending into the duct a distinct distance in order to provide optimal mixing. Fuel injection is further enhanced by designing the fuel distribution system such that the nozzles of the second ring extend further into the duct than the nozzles of the first ring, such that the nozzles of the third ring extend further into the duct than the nozzles of the second ring, and such more nozzles are provided in the first ring than in the second ring and in the second ring than in the third ring.

Preferably, the primary nozzle is generally frusto-conical in shape and is dimensioned to inhibit flashback and, in an especially preferred embodiment, has an included angle of about 15°.

Devices may be provided upstream of the fuel injection system to promote mixing upon the injection of fuel. Thus, a swirl promoting device may be provided located in the duct between the inlet and the fuel injection system to cause air flowing through the duct to swirl, thereby promoting mixing with fuel discharged from the nozzles. Similarly, if the air source comprises a centrifugal blower, a flow distribution orifice may be disposed in the duct between the inlet of the duct and the fuel injection system to prevent air from channeling along sidewalls of the duct.

Another object of the invention is to provide a dryer assembly receiving heat from a burner exhibiting the characteristics disclosed above.

In accordance with another aspect of the invention, this object is achieved by providing a dryer assembly including a rotary drum including a burner assembly and a combustion chamber having a burner inlet formed in an axial end thereof. The burner assembly includes a premix burner, an air source which supplies combustion air to the premix burner, and a fuel source which supplies a gaseous fuel to the premix burner. The premix burner includes a primary nozzle having an inlet and having an outlet opening into the combustion chamber, a burner duct having an inlet connected to the air source and an outlet connected to the inlet of the primary nozzle, and a fuel injection system including a plurality of nozzles spaced around the duct between the inlet and the outlet, extending into the duct, and terminating in injection orifices opening into the duct.

In order to inhibit flashback and to lengthen the life of the burner assembly, a cooling device, located adjacent the outlet of the primary nozzle, is preferably provided to inhibit heat transfer from the combustion chamber to the primary nozzle. The cooling device preferably comprises a metal ring which surrounds an outlet end of the primary nozzle and which is cooled with air supplied by the air source.

Yet another object of the invention is to provide an apparatus for precisely controlling the supply of both air and fuel to a premix burner to maintain emission levels at an acceptably low level under all operating conditions.

In accordance with yet another aspect of the invention, this object is achieved by providing a system including a premix burner having an outlet opening into a combustion chamber of a dryer, an air source supplying air to the premix burner, a fuel source supplying gaseous fuel to the premix burner, and means for electronically controlling the supply of fuel and air to the premix burner from the air source and fuel source. The means for electronically controlling includes a master firing rate controller which receives a desired firing rate command signal, and air and gas flow controllers which are connected to one another and to the master firing rate controller and which control the supply of air and fuel to the premix burner based upon signals received from the master firing rate controller and from one another.

In order to inhibit flashback when the firing rate is changing, means are preferably provided for periodically detecting whether a commanded firing rate requires an increase or a decrease in a then prevailing firing rate. Means, responsive to the means for detecting, are provided for causing some signals to be accepted and others disregarded. If the means for detecting detects an increase in the commanded firing rate, the means for causing (1) causes the gas flow controller to disregard signals from master firing rate controller and to accept signals from the air flow controller and (2) causes the air flow controller to disregard signals from the gas flow controller and to accept signals from the master firing rate controller. If, on the other hand, the means for detecting does not detect an increase in the commanded firing rate, the means for causing (1) causes the air flow controller to disregard signals from master firing rate controller and to accept signals from the gas flow controller and (2) causes the gas flow controller to disregard signals from the air flow controller and to accept signals from the master firing rate controller.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such changes.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

1. Resume

Pursuant to the invention, a premix burner assembly is provided which heats the combustion chamber of a dryer for an HMA plant, soil remediation plant, or the like and which meets the very low emission limitations that are imposed in certain areas such as the southern portion of California. The burner assembly includes a burner, a primary nozzle, an air source connected to the burner, a fuel source, and a fuel injection system connected to the fuel source and to the burner. Premixing is achieved through the supply of a gaseous fuel from the gas injection system into the burner upstream of the primary nozzle so as to lead to nearly complete premixing of the air and fuel prior to discharge into the combustion chamber, thereby permitting combustion of the fuel with only very small amounts of excess air. Burner efficiency is increased and emissions are further reduced by employing air distribution and control devices upstream of the fuel injection system and by carefully controlling the supply of both air and fuel to the burner. Preferably, burner firing is controlled by three separate controllers including a master firing rate controller, a gas supply controller, and an air supply controller which communicate with one another in different manners depending on whether or not the firing rate is increasing at a particular time.

2. Construction of Burner Assembly

A. Construction of Mechanical Portion of Burner

Figure 1:
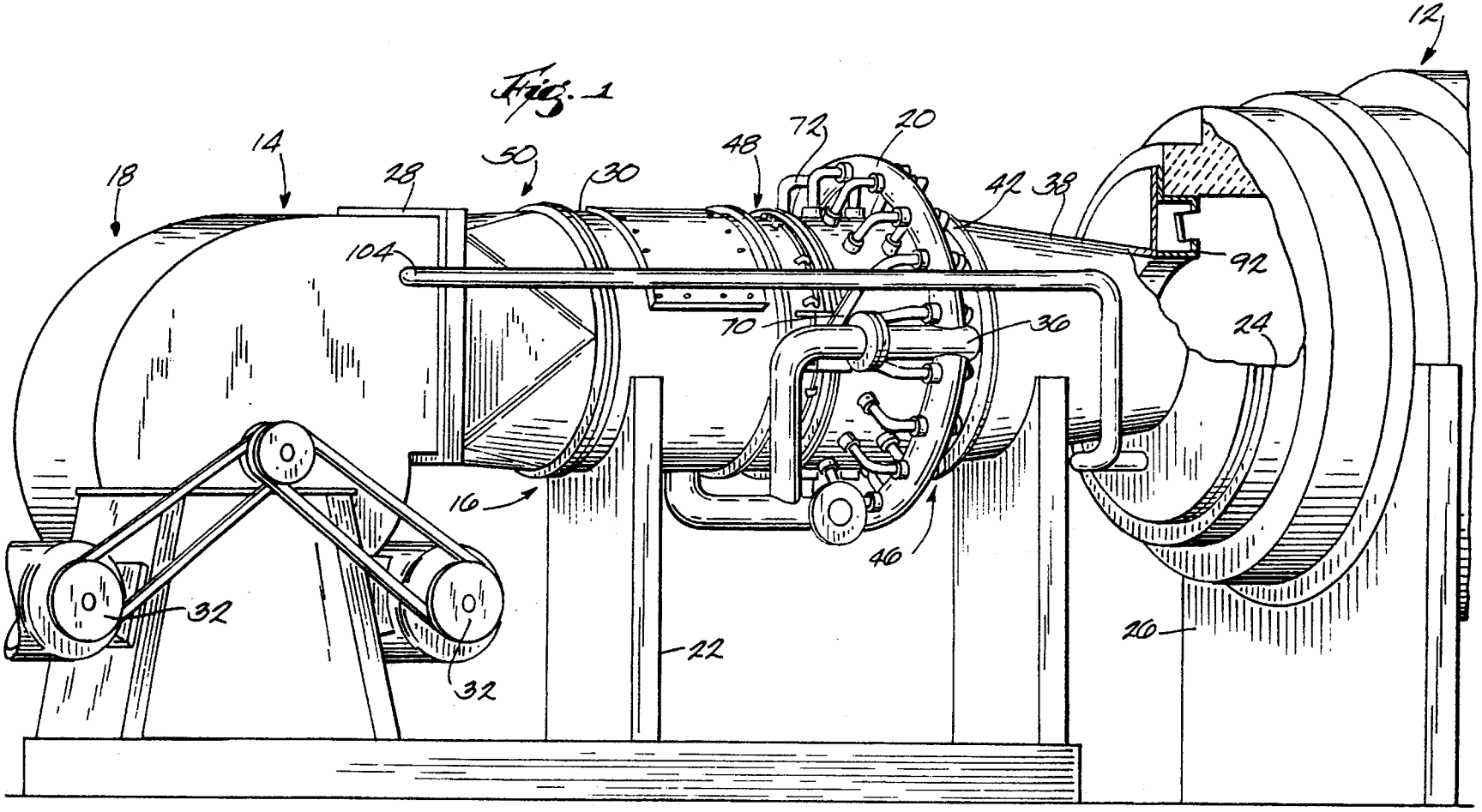
FIG. 1 is a partially cut away perspective view illustrating a burner assembly constructed in accordance with a preferred embodiment of the invention and cooperating with the end of a combustion chamber of a preferred dryer assembly.
Figure 2:
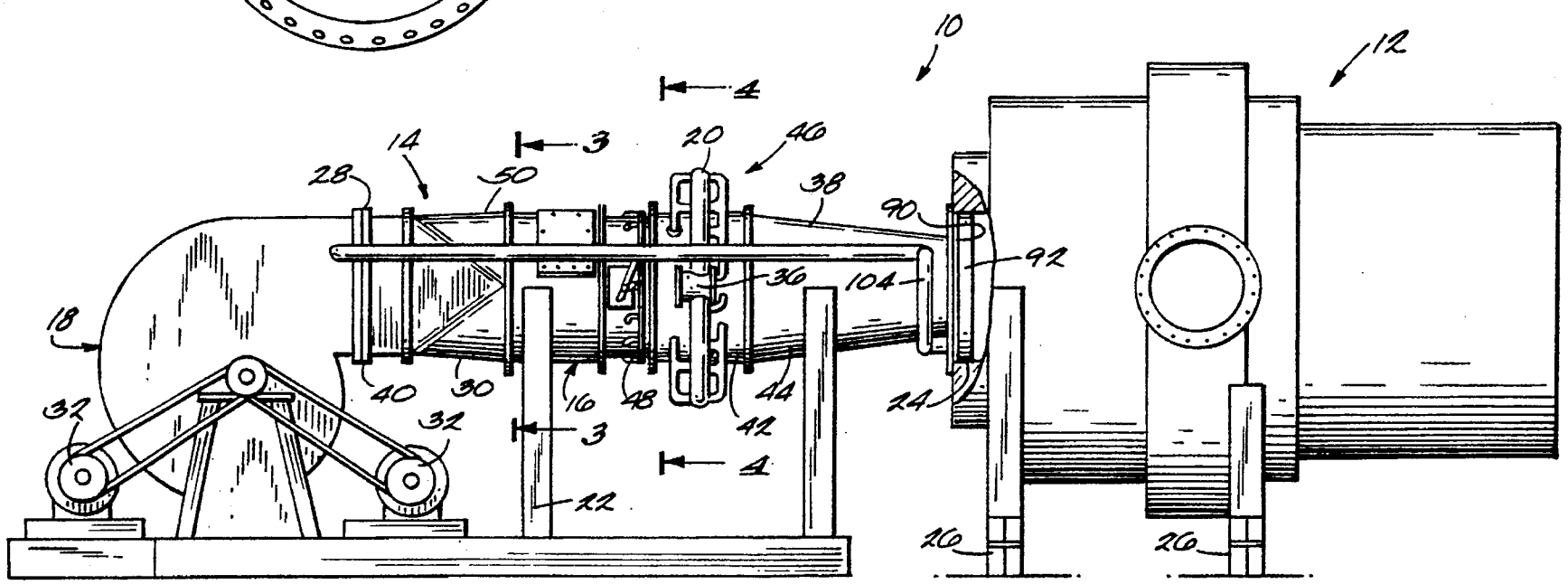
FIG. 2 is a side elevation view of the burner assembly and combustion chamber illustrated in FIG. 1.

Referring to the drawings and to FIGS. 1 and 2 in particular, a dryer assembly 10 includes (1) a dryer drum including a combustion chamber 12 and (2) a burner assembly 14 connected to the combustion chamber 12. The combustion chamber 12 may be formed in the end of any rotary drum dryer used for soil remediation or HMA production and, along with the burner assembly 14, is especially well suited for use with a dryer drum coater of the type manufactured by Astec Industries, Inc. of Chattanooga, Tenn. under the name "Double-Barrel Dryer" and generally describe in U.S. Pat. No. 4,867,572. The burner assembly 14 includes a premix burner 16, an air source 18 which supplies combustion air to the premix burner 16, and a fuel source 20 which supplies gaseous fuel to the premix burner 16. The entire burner assembly 14 is mounted on a suitable frame 22 so as to be generally level with a burner inlet 24 of the combustion chamber 12.

The air source 18 may comprise any suitable fan or blower and in the illustrated embodiment comprises a centrifugal blower powered in a conventional manner by electric motors 32. Blower 18 has a transverse inlet (not shown) and a radial outlet 28 opening longitudinally into a duct 30 of the burner 16.

The fuel source 20 may comprise any device capable of supplying fuel to burner 16 and, in the illustrated embodiment, comprises a manifold mounted on the exterior of the burner duct 30 by suitable brackets 34 (FIG. 5) and connected to a source of natural gas, propane, or another suitable gaseous fuel by a pair of spaced longitudinal feed pipes 36.

The premix burner 16 has at least a primary nozzle 38, the duct 30, and a fuel injection system 46 opening into the duct 30. Duct 30 has an inlet 40 connected to the outlet 28 of the blower 18 and an outlet 42 connected to an inlet 44 of the primary nozzle 38. A swirl promoting device 48 is preferably provided in the duct 30 upstream of the fuel injection system 46. In addition, depending upon the air source used, an air distribution device 50 may be provided in duct 30 upstream of the swirl promoting device 48. Each of these components will now be discussed in turn.

Figure 3:
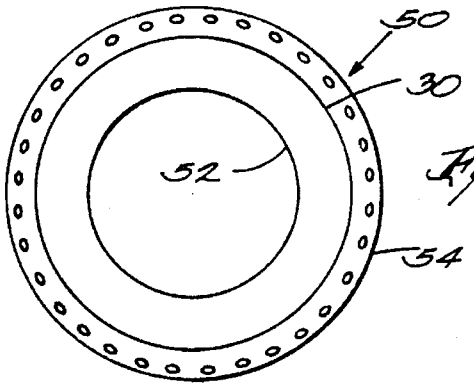
FIG. 3 is a sectional end elevation view taken along the lines 3—3 in FIG. 2.

The air distribution device 50 is optional and generally will be employed only if a centrifugal blower is used as the air source 18. The device 50 is beneficial when a centrifugal blower is employed because air as delivered by such blowers tends to channel along the surface of the burner duct 30, thereby inhibiting mixing in the downstream portions of the burner duct 30. The air distribution device 50 alleviates this problem by causing a pressure drop as air flows therethrough to ensure a redistribution of air downstream in the duct 30. An annular plate 52 (FIG. 3) mounted in the duct 30 by a flange 54 has been found to work particularly well for this purpose. The size of the orifice formed by plate 52 will vary from application to application and, in the 150 million BTU burner illustrated, should be about 24 inches in diameter.

Figure 4:
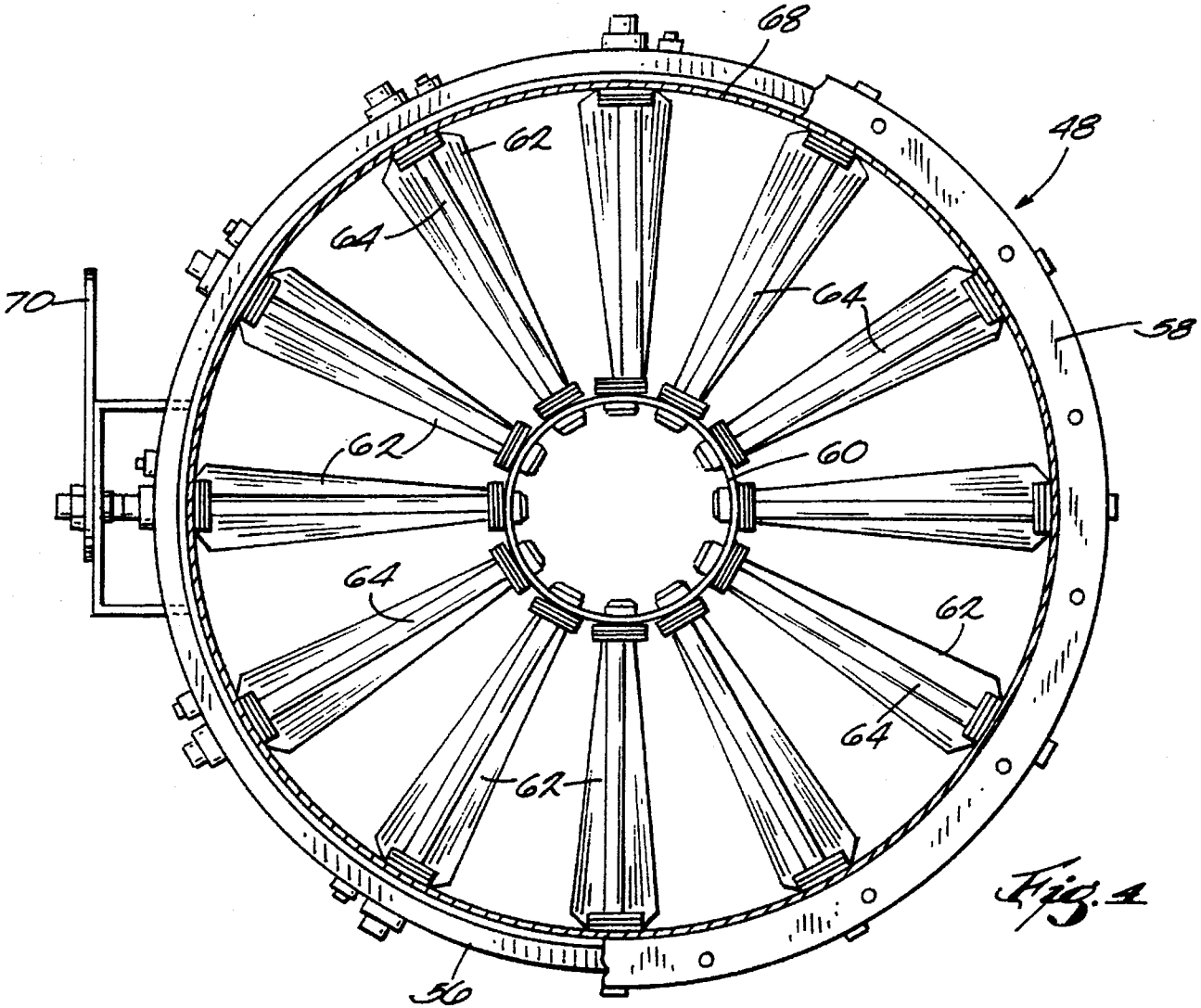
FIG. 4 is a sectional end elevation view taken along the lines 4—4 in FIG. 2.
Figure 5:
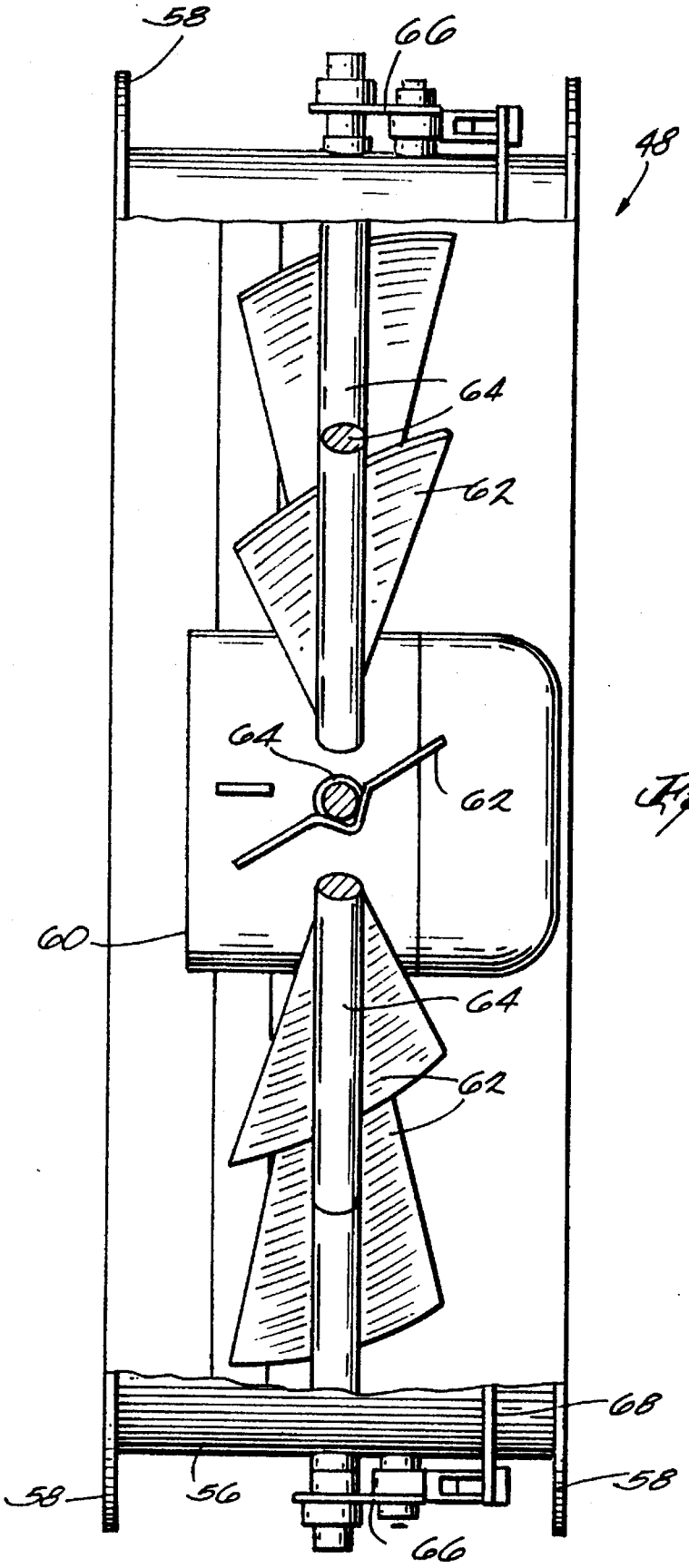
FIG. 5 is a partially cut-away perspective view of the swirl vane assembly illustrated in FIG. 4.
Figure 6:
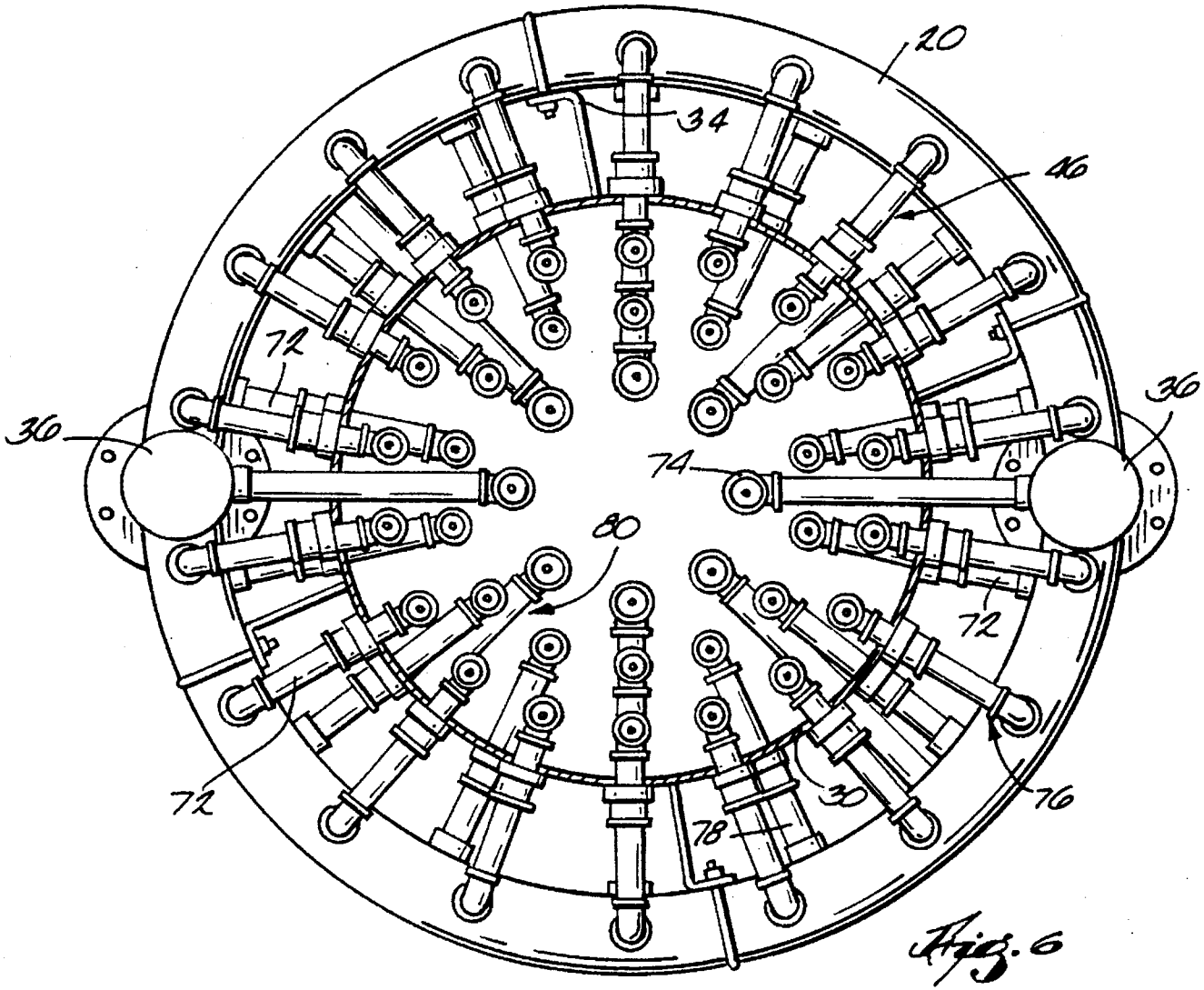
FIG. 6 is a sectional end elevation view taken along the lines 6—6 in FIG. 2.

The swirl promoting device 48 is designed to cause air flowing therethrough to swirl as it passes through the downstream portions of the duct 30 in which fuel is injected by system 46, thereby promoting mixing. Referring to FIGS. 4 and 5, swirl promoting device 48 comprises a swirl vane assembly including an outer shell 56 mounted in duct 30 by mounting flanges 58, an inner ring 60, and a plurality of vanes 62. Each of the vanes 62 extends radially from the inner ring 60 to the shell 56 and is rotatable about a support shaft 64 bolted to the inner ring 60 and to the outer shell 56. A link 66 connects each of the vanes 62 to a movable outer ring 68 which is in turn attached to a common adjustment lever 70. The thus constructed device, commonly used in the past as a damper in exhaust fans, permits all of the vanes 62 to be simultaneously adjusted between an angle of 0° and 60° (where 0° means parallel to the longitudinal centerline of the duct 30) upon suitable actuation of adjustment lever 70 in a manner which is, per se, well known. The amount of swirl induced will vary with the inclination of each vane 62 with maximum swirl being induced at 60°. It is anticipated at this time that vane orientation will be adjusted only infrequently and may only be adjusted once during initial start-up of the burner assembly 14 to set a desired amount of swirl in the duct 30.

Referring now to FIGS. 1, 2, 6, and 7, the fuel injection system 46 is designed to distribute gaseous fuel evenly through the cross-sectional area of the burner duct 30 as air passes therethrough so as to promote uniform mixing prior to discharge from the primary nozzle 38. To this end, a plurality of nozzles 72 extend radially through the shell of the burner duct 30 from the manifold 20 and terminate in gas discharge orifices 74 extending generally parallel with the direction of air flow. In order to maximize distribution, the nozzles 72 preferably form three concentric rings 76, 78, 80 with the nozzles 72 of each successive upstream ring extending further into the burner duct 30. Each successive upstream ring of nozzles 72 has more nozzles than the last to ensure adequate fuel distribution throughout the cross section of the duct 30. In the illustrated embodiment in which the fuel injection system 46 is used with a 150 million BTU burner the duct 30 of which has a diameter of about 3 feet, eighteen nozzles 72 are provided in downstream ring 76 with the orifices 74 spaced about 1 foot, 3 inches from the center of duct 30; fourteen nozzles 72 are provided in center ring 78 with the orifices 74 spaced about 11 inches from the center of duct 30; and eight nozzles 72 are provided in upstream ring 80 with the orifices 74 spaced about 7 inches from the center of duct 30. The size of the orifices 74 of each ring 76, 78,80 is also set to promote an even distribution of fuel into all portions of the air passing through the injection section of the duct 30 and, accordingly, increases in each downstream ring.

Each nozzle 72 comprises a pipe extending radially from the manifold 20 through the shell of the burner duct 30, a 90° elbow 82 mounted on the lower end of the pipe, and a conventional gas orifice 74 mounted on the end of the pipe so as to extend generally horizontally through the duct 30. It is desirable to permit adjustment of the orientation of each orifice 74 with respect to the longitudinal centerline of the duct 30 in order to maximize fuel distribution. To simplify construction while still permitting such adjustment, each radial pipe is formed from first and second pipes 84 and 86 connected to one another via a friction fit sleeve 88 mounted on the outer surface of the burner duct 30. The outer pipe 84 extends inwardly from the manifold 20 to the sleeve 88, and the inner pipe 86 extends inwardly from the sleeve 88 to the elbow 82. This friction connection permits rotation of the inner pipe 86 relative to the outer pipe 84 while maintaining a gas tight connection therebetween.

Figure 8:
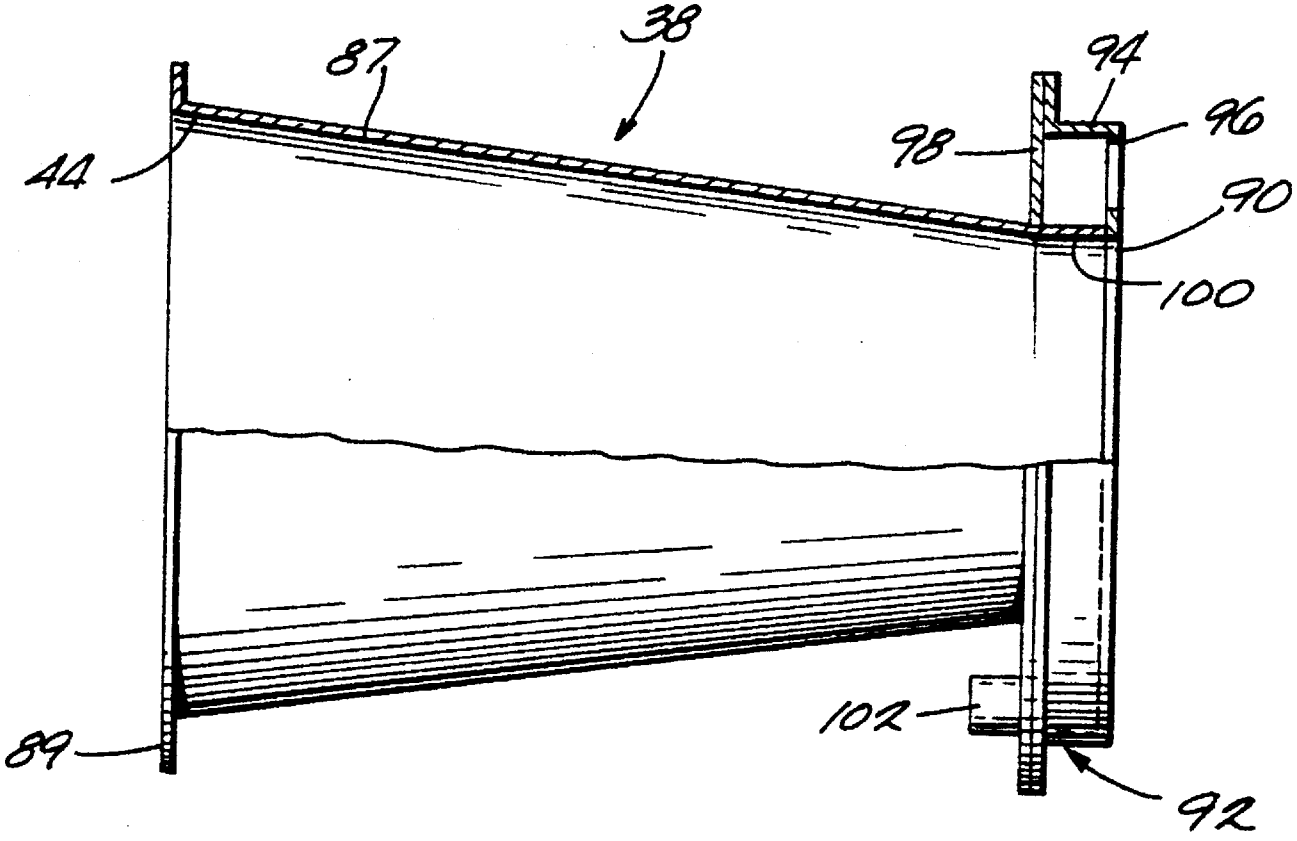
FIG. 8 is a sectional side elevation view of the primary nozzle of the burner assembly of FIGS. 1 and 2.

Referring to FIGS. 1, 2, and 8, primary nozzle 38 is designed to discharge into the burner inlet 24 of the combustion chamber 12 the air/fuel mixture formed when fuel is injected into the duct 30 by fuel injection system 46. Primary nozzle 38 includes a shell 87 having the inlet 44 formed in the front end thereof and an outlet 90 formed in the rear end thereof. A radial flange 89 is formed on the front end of the shell 87 for connection to the burner duct 30. Unlike a nozzle mix burner traditionally used in HMA plants and the like, the primary nozzle 38 should be specially shaped to prevent flashback. Flashback occurs when a burner flame propagates upstream into a burner and occurs as a result of the fact that there is a fuel/air mixture at every point in the burner downstream of the location in which fuel is injected into the airstream flowing through the duct. Flashback can be prevented by maintaining the outward velocity of the air/fuel mixture exiting the primary nozzle above the flame propagation rate (typically about 10 feet per second for laminar flow). If the mixture velocity drops to or below the flame propagation rate, the flame may flash back into the burner creating dangerous conditions to the equipment and possibly to personnel. This phenomenon can be avoided by designing the primary nozzle 38 to accelerate the air/fuel mixture as it flows through the primary nozzle 38 to produce the highest mixture velocity at the outlet of the primary nozzle, and to maintain this velocity above the flame propagation rate. This object is achieved by properly sizing the average diameter of the primary nozzle 38 relative to the blower 18 and by providing a frusto-conical primary nozzle 38 which narrows continuously from the upstream to downstream ends thereof, thereby assuring adequate fluid velocity at the outlet 90 of the primary nozzle 38. The taper provided by this frusto-conical nozzle 38 must be gradual so as to prevent turbulent flow because turbulent flow tends to increase dramatically the flame propagation rate, thereby increasing the danger of flashback. Applicant has found that turbulence is avoided while still providing the required acceleration if the included angle of the primary nozzle 38 is no more than 10° to 20° and preferably about 15°.

A cooling device 92 is preferably mounted on the front end 100 of primary nozzle 38 to guard further against flashback and to increase burner life by reducing the conduction of heat to the metal primary nozzle 38 from the refractory lined combustion chamber 12. The cooling device or ring 92 includes an annular housing 94 surrounding the outlet end 90 of the primary nozzle 38 and extending into the combustion chamber 12. The housing 94 is enclosed at its front end by a first annular plate 96 and at its back end by a second annular plate 98 extending radially outwardly from the housing 94 to provide a sealing flange for sealing against the outer axial end of the combustion chamber 12. A coupling 102 extends rearwardly from the housing 94 and is connected to a conduit 104 receiving cooling air from the air source 18.

B. Construction of Control System

Figure 9:
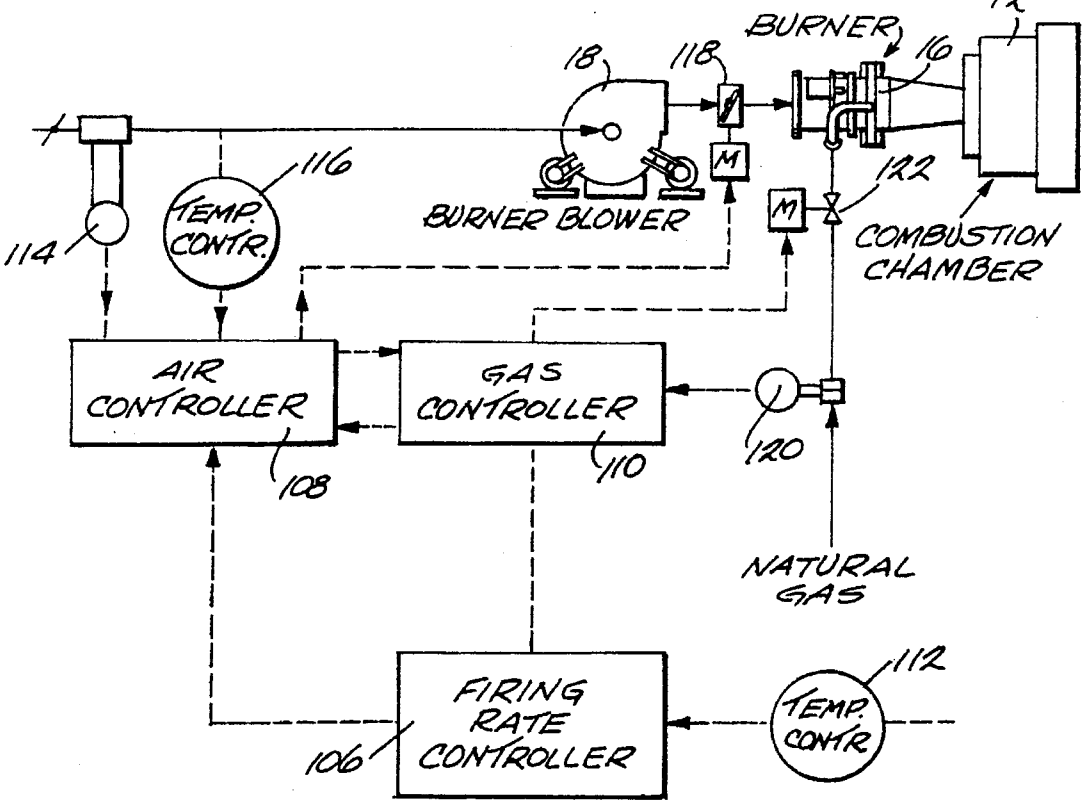
FIG. 9 schematically represents a control system for controlling the operation of the burner assembly of FIGS. 1 and 2.
Figure 7:
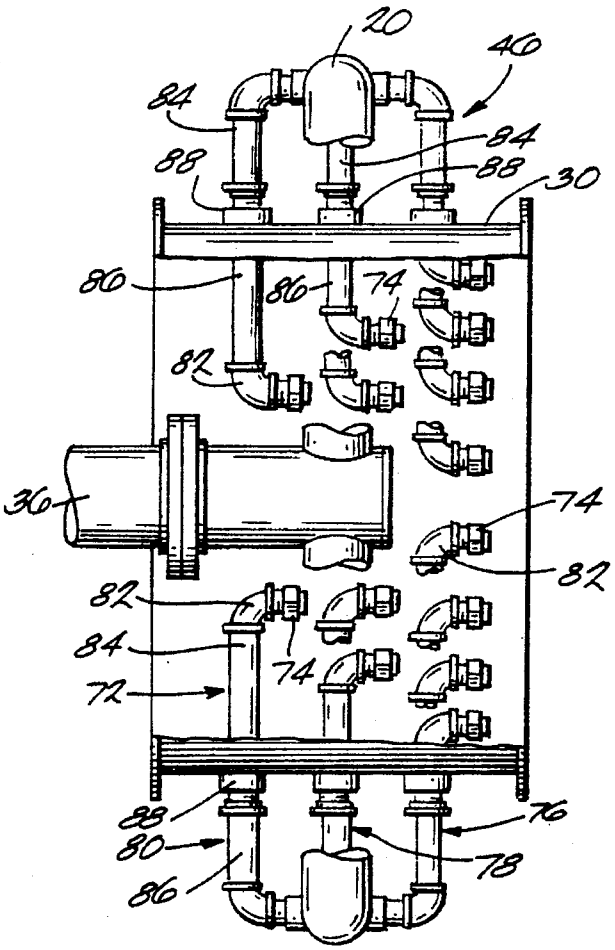
FIG. 7 is a partially cut-away perspective view of the fuel injection assembly illustrated in FIG. 6.

Reducing emissions using the illustrated premix burner assembly 16 is best achieved by exercising much more precise control over the air/fuel ratio than is typically exercised by nozzle mix burners. Referring now to FIG. 9, the air/fuel ratio is controlled by controlling the supply of both air and fuel to the burner 16 using a master firing rate controller 106, an air flow controller 108, and a gas flow controller 110. Each of these controllers can take the form of an off-the-shelf programmable digital microprocessor such as the Models 3000 and 6000 manufactured by Honeywell.

The master firing rate controller 106 receives a command signal which is input either manually or automatically and which represents either directly or indirectly a commanded firing rate. Typically, this command signal will be input manually using a temperature controller 112 which sets a desired temperature within the dryer and which thus provides an indirect indication of the commanded firing rate. Master firing rate controller 106 determines desired flow rates of fuel and air required for the commanded firing rate and transmits control signals to the controllers 108 and 110.

Air flow controller 108 has inputs connected to (1) master firing rate controller 106, (2) the gas flow controller 110, (3) a differential pressure transducer 114 located in the inlet stream of the blower 18, and (4) a temperature sensor 116 located in the inlet stream of the blower 18. Air flow controller 108 also has outputs connected to (1) an electronically controlled damper 118 located between the blower 14 and the burner 16, and (2) the gas flow controller 110. The differential pressure signal and temperature signal provided by the sensors 114 and 116 provide an indication of the air flow rate through the blower 18 and thus can be used as feedback to set the damper position to provide the air flow commanded by the master firing rate controller 106 or the gas flow controller 110 as detailed below.

Gas flow controller 110 has inputs connected to (1) master firing rate controller 106, (2) the air flow controller 108, and (3) a differential pressure transducer 120 located in the inlet pipe for the manifold 20. Gas flow controller 110 also has outputs connected to (1) an electronically controlled variable flow valve 122 located in the inlet pipe for the manifold 20 and (2) the air flow controller 108. The differential pressure signal provided by the transducer 120 provides an indication of the fuel flow rate through the manifold 20 and thus can be used as feedback to set the position of valve 122 to provide the fuel flow commanded by the master firing rate controller 106 or the air flow controller 108 as detailed below.

3. Operation of Burner Assembly

In use, air is supplied to the inlet of burner duct 30 from the blower 18 and flows through the duct 30 towards the fuel injection system 46. Air flowing along the surface of the duct 30 is distributed more evenly through the duct 30 as it flows through the air distribution orifice provided by device 50, and the thus distributed air is set into a swirling motion as it passes through the swirl vane assembly 48. The thus swirling air then enters the portion of the duct 30 receiving the fuel injection system 46, where natural gas, propane, or another gaseous fuel is discharged from the orifices 74 into the airstream. The distribution of the orifices 74 within the duct 30, along with the orientation of each orifice 74 with respect to the passing airstream, maximizes distribution of fuel in the airstream and promotes rapid mixing. The air/fuel mixture then enters the primary nozzle 38 and is accelerated without turbulence as it passes through the primary nozzle 38 before being discharged into the combustion chamber 12 of the dryer. The mixture contacts flame from previously ignited fuel upon entering the combustion chamber 12 and ignites without flashback. The flame produced in the combustion chamber 12 propagates into the interior of the rotary drum (not shown) thereby heating materials such as HMA or contaminated soils disposed therein. Combustion of the mixture within the chamber 12 can if desired be enhanced by employing a stepped inlet in the combustion chamber 12 such as that disclosed in U.S. Pat. No. 5,334,012 to Brock et al.

Substantially all combustion air is supplied by blower 18. This is in contrast to most nozzle mix burners which, as discussed above, receive only a portion of the combustion air directly from the blower. The air/fuel mixture supplied to the burner 16 by blower 18 is carefully maintained by controllers 106, 108, and 110 at a level which minimizes emissions while inhibiting flashback. Applicant has found that some excess air is required to avoid flashback and to maintain VOC emissions within acceptable limits but that operating with excess air of more than about 5% leads to increased NOx emissions. Maintaining an excess air ratio of about 4% to 5% has been found to limit both VOC and NOx emissions to acceptable levels and to help avoid flashback. Operating with relatively small amounts of excess air also significantly reduces the amounts of both air and fuel required for adequately heating a given size drum as compared to the same size drum heated by nozzle mix burners requiring much higher levels of excess air. This significantly increases the thermal efficiency of the process while permitting the use of a smaller and less powerful blower.

The air/fuel ratio in burner 16 is maintained at the desired excess air levels of about 4% to 5% at all commanded firing rates using the controllers 106, 108, and 110. Specifically, a signal representative of the desired temperature in the dryer is transmitted to the master firing rate controller 106 from input device 112. The master firing rate controller 106, having the air/fuel ratio required for the 4% to 5% desired excess air programmed therein, then determines the amounts of fuel and air required for the commanded firing rate and transmits command signals to the controllers 108 and 110.

Each of the controllers 108 and 110 receives the command signal from the master firing rate controller 106 and independently calculates the rates at which air or fuel is to be supplied by the other controller 110 or 108 based upon the commanded supply rate of fuel or air. Thus, the gas flow controller 110 transmits an air supply command signal to the air flow controller 108 which meets the desired air/fuel mixture for a given fuel supply rate, and vice versa. This provides a safety mechanism which inhibits flashback by preventing the air/fuel ratio from becoming dangerously low when the firing rate is increasing. That is, if both air and fuel delivery were controlled solely by the commanded firing rate as delivered by the master firing rate controller 106, the fuel supply rate could increase more rapidly than the air supply rate, thereby dropping the air/fuel ratio to dangerously low levels. This problem can be avoided by suitably programming the gas flow controller 110 to let the air flow controller 108 lead the way in any such changes. Specifically, the gas flow controller 110 is programmed to detect, based upon a comparison of the previously sensed fuel flow rates to the then-existing fuel flow rate, whether or not the firing rate is increasing at that time. If the answer to this inquiry is affirmative, the gas flow controller 110 disregards the command signal from the master firing rate controller 106 and accepts the command signal from the air flow controller 108 to set a fuel supply rate. The air flow controller 108, having independently determined that the firing rate is increasing using a technique identical to that employed by the gas flow controller 110, disregards command signals from the gas flow controller 110 and accepts signals from the master firing rate controller 106, thereby assuring that the air flow controller 108 leads the way. Thus, when the firing rate is increasing, the air flow controller 108 accepts command signals only from master firing rate controller 106 and the gas flow controller 110 accepts command signals only from the air flow controller 108.

Similarly, when the firing rate is decreasing or remains the same, it is desirable to set the air supply rate based upon the then-existing fuel supply rate so as to prevent the air supply rate from decreasing more rapidly than the fuel supply rate. In this instance, the gas flow controller 110 leads the way and accepts command signals from the master firing rate controller 106 while disregarding command signals from the air flow controller 108. The air flow controller 108 disregards signals from the master firing rate controller 106 and accepts signals from the gas flow controller 110. Thus, under all operating conditions, if the air flow controller 108 is not accepting command signals from the master firing rate controller 106, it is accepting signals from the gas flow controller 110, and vice versa.

Many changes and modifications may be made without departing from the spirit of the invention, and the scope of such changes will become apparent from the appended claims.

I claim:

1. A burner assembly for a dryer drum, comprising:

(A) a premix burner;

(B) an air source which supplies combustion air to said premix burner; and (C) a fuel source which supplies gaseous fuel to said premix burner, wherein said premix burner includes (1) a primary nozzle having an inlet and having an outlet for discharging an uncombusted air/gaseous fuel mixture into said dryer drum, (2) a burner duct having an inlet connected to said air source and an outlet connected to said inlet of said primary nozzle, and (3) a fuel injection system including a plurality of nozzles spaced around said duct between said inlet and said outlet, each of said nozzles a) extending into said duct, b) having an inlet connected to said fuel source, c) and terminating in an injection orifice opening into said duct, wherein said air source supplies to said premix burner substantially all combustion air required for complete combustion of all fuel supplied by said fuel source.

2. A burner assembly for a dryer drum, comprising:

(A) a premix burner;

(B) an air source which supplies combustion air to said premix burner; and (C) a fuel source which supplies gaseous fuel to said premix burner, wherein said premix burner includes (1) a primary nozzle having an inlet and having an outlet for discharging an air/fuel mixture into said dryer drum, (2) a burner duct having an inlet connected to said air source and an outlet connected to said inlet of said primary nozzle, and (3) a fuel injection system including a plurality of nozzles spaced around said duct between said inlet and said outlet, extending into said duct, and terminating in injection orifices opening into said duct, wherein said fuel source comprises a manifold, and wherein said nozzles are mounted on said manifold and extend radially into said duct in at least first, second, and third concentric rings with the orifices of each ring extending into said duct a distinct distance in order to provide optimal mixing.

3. A burner assembly as defined in claim 2, wherein the nozzles of said second ring extend further into said duct than the nozzles of said first ring, wherein the nozzles of said third ring extend further into said duct than the nozzles of said second ring, and wherein there are more nozzles in said first ring than in said second ring and in said second ring than in said third ring.

4. A burner assembly as defined in claim 1, wherein the orientation of said injection orifices with respect to a longitudinal centerline of said duct is adjustable.

5. A burner assembly as defined in claim 1, wherein said primary nozzle is generally frusto-conical in shape so as to taper inwardly in diameter continuously from said inlet thereof towards said outlet thereof and is dimensioned to inhibit flashback.

6. A burner assembly as defined in claim 5, wherein said primary nozzle has an included angle of about 15°.

7. A burner assembly as defined in claim 1, further comprising a swirl promoting device, located in said duct between said inlet and said fuel injection system, which causes air flowing through said duct to swirl, thereby promoting mixing with fuel discharged from said nozzles.

8. A burner assembly as defined in claim 7, wherein said swirl promoting device comprises a plurality of adjustable vanes spaced around said duct.

9. A burner assembly as defined in claim 1, wherein said air source comprises a centrifugal blower, and further comprising a flow distribution orifice disposed in said duct between the inlet of said duct and said fuel injection system to prevent air from channeling along sidewalls of said duct.

10. A burner assembly as defined in claim 9, wherein said air distribution orifice is formed from an annular plate mounted in said duct.

11. A burner assembly as defined in claim 1, further comprising means for electronically controlling the supply of fuel and air to said duct from said air source and fuel source.

12. A burner assembly as defined in claim 11, wherein said means for electronically controlling comprises a master firing rate controller and air and fuel flow controllers connected to one another and to said master firing controller.

13. A dryer assembly comprising:

(A) a rotary drum including a combustion chamber having a burner inlet formed in an axial end thereof; and (B) a burner assembly including (1) a premix burner, (2) an air source which supplies combustion air to said premix burner, and (3) a fuel source which supplies a gaseous fuel to said premix burner, wherein said premix burner includes (a) a primary nozzle having an inlet and having an outlet, opening into said combustion chamber, for discharging an uncombusted air/gaseous fuel mixture into said combustion chamber, (b) a burner duct having an inlet connected to said air source and an outlet connected to said inlet of said primary nozzle, and (c) a fuel injection system including a plurality of nozzles spaced around said duct between said inlet and said outlet, b) having an inlet connected to said fuel source, c) and terminating in an injection orifice opening into said duct, wherein said air source supplies to said premix burner substantially all combustion air required for complete combustion of all fuel supplied by said fuel source.

14. A dryer assembly comprising:

(A) a rotary drum including a combustion chamber having a burner inlet formed in an axial end thereof; and (B) a burner assembly including (1) a premix burner, (2) an air source which supplies combustion air to said premix burner, and (3) a fuel source which supplies a gaseous fuel to said premix burner, wherein said premix burner includes (a) a primary nozzle having an inlet and having an outlet opening into said combustion chamber, (b) a burner duct having an inlet connected to said air source and an outlet connected to said inlet of said primary nozzle, and (c) a fuel injection system including a plurality of nozzles spaced around said duct between said inlet and said outlet, extending into said duct, and terminating in injection orifices opening into said duct, wherein said nozzles are arranged in at least first, second, and third concentric rings with the orifices of each ring extending radially into said duct a distinct distance in order to provide optimal mixing.

15. A dryer assembly as defined in claim 14, wherein the nozzles of said second ring extend further into said duct than the nozzles of said first ring and said nozzles of the third ring extend further into said duct than the nozzles of said second ring, and wherein there are more nozzles in said first ring than in said second ring and in said second ring than in said third ring.

16. A dryer assembly as defined in claim 13, wherein the orientation of said injection orifices with respect to a longitudinal centerline of said duct is adjustable.

17. A dryer assembly comprising:

(A) a rotary drum including a combustion chamber having a burner inlet formed in an axial end thereof;

(B) a burner assembly including (1) a premix burner, (2) an air source which supplies combustion air to said premix burner, and (3) a fuel source which supplies a gaseous fuel to said premix burner, wherein said premix burner includes (a) a primary nozzle having an inlet and having an outlet opening into said combustion chamber, (b) a burner duct having an inlet connected to said air source and an outlet connected to said inlet of said primary nozzle, and (c) a fuel injection system including a plurality of nozzles spaced around said duct between said inlet and said outlet, extending into said duct, and terminating in injection orifices opening into said duct; and (C) a cooling device, located adjacent said outlet of said primary nozzle, which inhibits heat transfer from said combustion chamber to said primary nozzle.

18. A dryer assembly as defined in claim 17, wherein said cooling device comprises a metal ring which surrounds an outlet end of said primary nozzle and which is cooled with air supplied by said air source.

19. A dryer assembly comprising:

(A) a rotary drum including a combustion chamber having a burner inlet formed in an axial end thereof; and (B) a burner assembly including (1) a premix burner having an outlet for discharging an uncombusted air/gaseous fuel mixture into said burner inlet of said combustion chamber, said premix burner including a duct, and (2) an air source which supplies to said premix burner substantially all combustion air required for combustion, wherein said premix burner further includes a fuel injection system which injects gaseous fuel into said premix burner downstream of said air source so as to promote uniform mixing of fuel and air prior to discharge into said burner inlet of said combustion chamber, said fuel injection system including a source of said gaseous fuel and a plurality of nozzles spaced around said duct, each of said nozzles a) having an inlet connected to said fuel source, and b) terminating in an injection orifice opening into said duct.

20. A dryer as defined in claim 19, wherein said premix burner further includes (A) a primary nozzle having an inlet and having an inlet connected to said duct and having an outlet opening into said burner inlet of said combustion chamber.

21. A system comprising:

(A) a premix burner having an outlet opening into a combustion chamber of a dryer;

(B) an air source supplying air to said premix burner;

(C) a fuel source supplying gaseous fuel to said premix burner;

(D) means for electronically controlling the supply of fuel and air to said premix burner from said air source and fuel source, said means for electronically controlling including (1) a master firing rate controller which receives a desired firing rate command signal, and (2) air and gas flow controllers which are connected to one another and to said master firing rate controller and which control the supply of air and fuel to said premix burner based upon signals received from said master firing rate controller and from one another;

(E) means for periodically detecting whether a commanded firing rate requires an increase or a decrease in a then prevailing firing rate; and (F) means, responsive to said means for detecting, for causing some signals to be accepted and others disregarded, wherein, if said means for detecting detects an increase in the commanded firing rate, said means for causing (1) causes said gas flow controller to disregard signals from master firing rate controller and to accept signals from said air flow controller and (2) causes said air flow controller to disregard signals from said gas flow controller and to accept signals from said master firing rate controller, and wherein, if said means for detecting does not detect an increase in the commanded firing rate, said means for causing (1) causes said air flow controller to disregard signals from master firing rate controller and to accept signals from said gas flow controller and (2) causes said gas flow controller to disregard signals from said air flow controller and to accept signals from said master firing rate controller.

22. A burner assembly as defined in claim 1, wherein said fuel source comprises a manifold, and wherein said nozzles are mounted on said manifold and extend radially into said duct in at least first and second concentric rings with the orifices of each ring extending into said duct a distinct distance in order to provide optimal mixing.

23. A dryer assembly as defined in claim 13, wherein said fuel source comprises a manifold, and wherein said nozzles are mounted on said manifold and extend radially into said duct in at least first and second concentric rings with the orifices of each ring extending into said duct a distinct distance in order to provide optimal mixing.

24. A dryer assembly as defined in claim 19, wherein said fuel source comprises a manifold, and wherein said nozzles are mounted on said manifold and extend radially into said duct in at least first and second concentric rings.

25. A dryer assembly as defined in claim 20, wherein said primary nozzle is generally frusto-conical in shape so as to taper inwardly in diameter continuously from said inlet thereof towards said outlet thereof and is dimensioned to inhibit flashback.

* * * * *